United States Patent [19]

Gorre et al.

[11] 4,395,087

[45] Jul. 26, 1983

[54] STRIP OF BORDER-HELD CONTACT ELEMENTS FOR A CONNECTION DEVICE, AND A PROCESS FOR FORMING SUCH CONTACT ELEMENTS

[75] Inventors: Paul Gorre; Jean M. Giraud, both of Suresnes, France

[73] Assignee: Socapex, Suresnes, France

[21] Appl. No.: 240,482

[22] Filed: Mar. 4, 1981

[30] Foreign Application Priority Data

Mar. 7, 1980 [FR] France ..... 80 05203

[51] Int. Cl.[3] ..... H01R 13/00

[52] U.S. Cl. ..... 339/278 R; 206/343; 339/276 SF

[58] Field of Search ..... 339/276 SF, 278; 29/874, 884; 206/330, 343

[56] References Cited

U.S. PATENT DOCUMENTS

| | | | |
|---|---|---|---|
| 2,995,617 | 8/1961 | Just et al. | 174/153 |
| 3,601,890 | 8/1971 | Pityo et al. | 29/874 |
| 3,795,889 | 3/1974 | Nauman et al. | 339/276 SF |
| 3,975,072 | 8/1976 | Ammon | 339/17 LC |
| 4,021,095 | 5/1977 | Kinkaid et al. | 339/276 SF |
| 4,037,915 | 7/1977 | Cabaud | 339/276 SF |

FOREIGN PATENT DOCUMENTS

| | | |
|---|---|---|
| 2386916 | 4/1978 | France . |
| 2424689 | 4/1978 | France . |

*Primary Examiner*—Joseph H. McGlynn
*Assistant Examiner*—Paula Austin
*Attorney, Agent, or Firm*—Oblon, Fisher, Spivak, McClelland & Maier

[57] ABSTRACT

The invention relates to the field of contact elements for electric connection. In use, when these elements are positioned and connected to the wiring of circuits by automatic machines, they are fixed in a large number on a supporting strip or border, from which they are successively detached by a V-shaped cut. In accordance with the invention, they are firmly secured by means of a transverse V-section bar supported by a stirrup. After the V cut, the contact thus presents advantageously a pyramid-shaped point.

3 Claims, 6 Drawing Figures

FIG_1
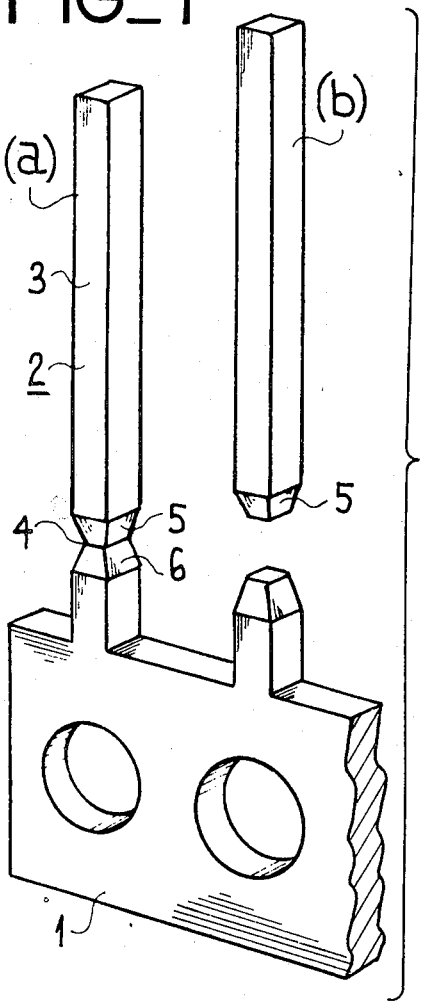
FIG_3
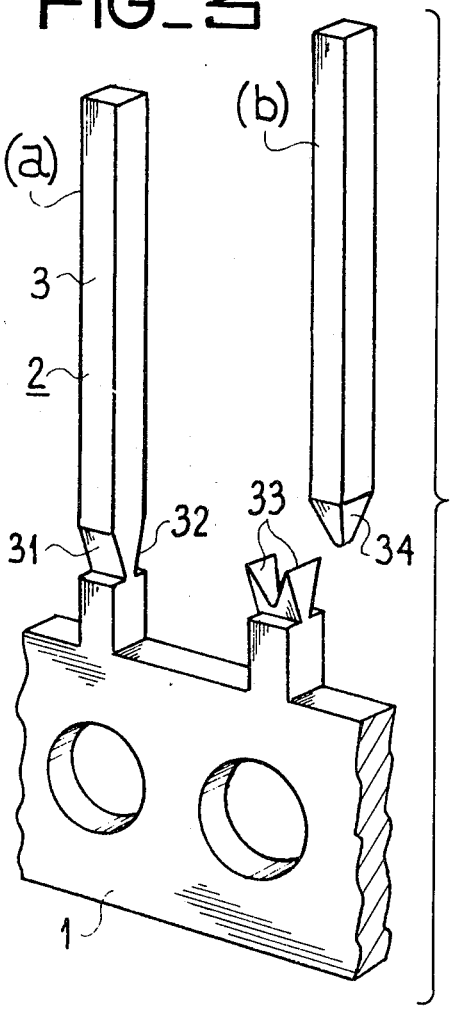
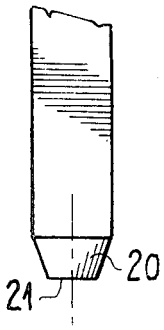
FIG. 2a
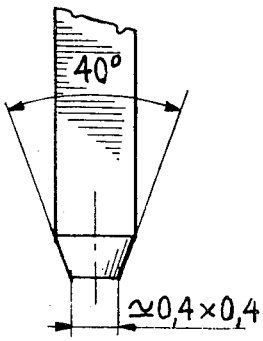
FIG. 2b
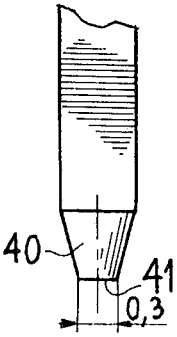
FIG. 4a
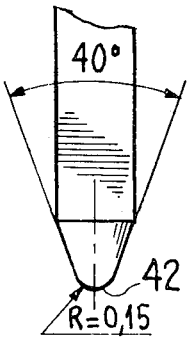
FIG. 4b FIG_5
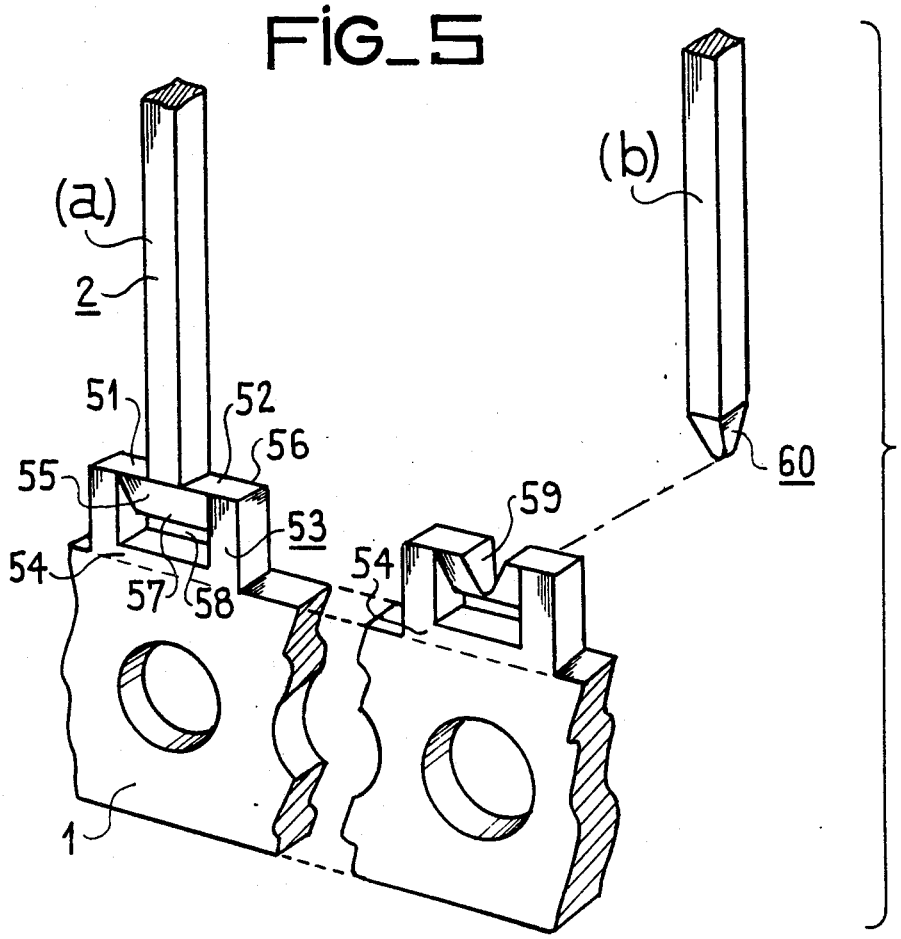
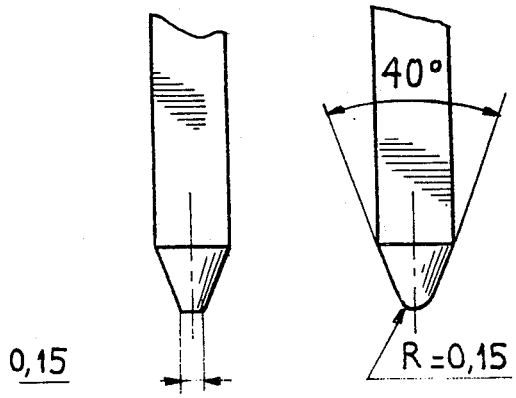
FIG. 6a FIG. 6b

STRIP OF BORDER-HELD CONTACT ELEMENTS FOR A CONNECTION DEVICE, AND A PROCESS FOR FORMING SUCH CONTACT ELEMENTS

BACKGROUND OF THE INVENTION

The present invention relates to the field of electrically conducting contact elements used for the connection of electrical circuits, either in connectors, where they are housed in supports made from an insulating material, or individually by implantation in board circuits, through openings of a suitable diameter. Such contact elements have a general structure formed from a front part whose function is to ensure the electrical contact with another external element, a middle part usually carrying fixing elements such as lugs or hooks, and a rear part, terminal or "contact tail", for connection with the wires or wiring elements of the circuits to be connected.

Due to the increasing industrial tendency to reduce manufacturing costs, manual positioning of the contact elements is being replaced more and more by automatic implantation thereof. The presentation in large quantities the best adapted for supplying the implantation machine is the securing of the contact elements on a continuous strip, most often by their rear end, or contact tail, forming a temporary support from which they are removed at the time of implantation.

A frequent operating method is to form, from the same metal material, the contact elements and the supporting strip to which they are fixed, the separation operation taking place by breaking a previously thinned-down part of the tail by which the contact is fixed to the supporting strip.

The assembly is then in the form of a thin and flexible metal strip, often called "border", on one side of which, arranged like a comb, a plurality of contact elements are fixed by their tail, these elements being punched out. This method of presentation is advantageous in that it allows the contacts to undergo all the manufacturing treatment operations, such as electroplating for example, as well as their storage then their implantation, while keeping them on the supporting border rolled up on a mandrel.

It is by means of the thinned part of the contact tail that, after separation, the contact element is then implanted, either by being mounted in a connecting body, or directly by being mounted in a board circuit.

It is also on this part, square or rectangular in section, that by use of a rotary-end wiring tool, the connection with the cabling wire of the equipment is carried out for example by wrapping.

To minimize the consequences of the geometrical fluctuations of the position of the contacts during these mechanized operations of implantation and wrapping, it is necessary for the contact tail to be pointed, in the shape of a cone or a pyramid, which ensures the automatic correction of positioning errors.

Now this point is created from the part of the tail previously thinned-down for breaking and separation from the supporting strip, and there is a risk of incompatibility between the two functions assumed by this thinned-down part.

In fact, during handling of the strip fitted with its contacts, and in particular during the depositing of a protecting metal layer by electroplating, the thinned-down portion of the tail participates in a first function, that of securing the contact element. It is then highly desirable for the thinning to be limited to a value which retains for this portion a high resistance to bending, so as to avoid at this point any risk of deformation, which may even lead to premature separation of some elements.

On the other hand, the thinned-down portion assumes, after the operation for separating the contact, a second function, that of guide point for mounting and wrapping, which function requires a thinned-down portion having a shape forming a sharp point, in the form of a pyramid with negligible truncation. Now this condition is contradictory to the first one, for it leads to adopting considerable thinning down, with all the drawbacks explained above, whereas, from the first function thereof, it follows that a very moderate value thereof should be adopted which leads, with harmful consequences, after the contact has been detached, to a heavily truncated pyramid-shaped point, totally inadapted to the role of fitting guide, the need for which was shown above.

SUMMARY OF THE INVENTION

The strip of border or edge-held contacts provided by the invention does not comprise these drawbacks.

It provides a very high resistance to bending at the level of the pre-thinned portion, while allowing this latter to be given after shearing and separation, the advantageous shape of a pyramid having very small truncation.

Fundamentally, it is based on a complete separation between the two functions assumed by the thinned-down portion of the contact tail, namely, as was explained above, securing of the contact and formation of a point.

According to the invention, the thinned-down portion of the contact tail only assumes the second function, i.e. the formation of the point, the function for securing the contact being assumed by separate means independent of the thinned-down portion. This separation of the functions gives the simultaneous possibility of firmly securing the contact on the border or edge during all the handling operation, chemical and electroplating treatments, and during the formation of a pyramid-shaped point having very small truncation.

More precisely, the invention relates to a strip of edge-held contacts for a connection device, comprising a support forming the border, in the form of a ribbon, and a plurality of contact elements in the form of rectangular-section rails, fixed by one of their ends to one of the sides of the border by a securing means, in a comb arrangement, the border, the elements and their securing means being formed from the same continuous electrically conducting material, wherein the securing means is formed by a bar disposed perpendicularly to the axis of the rail along two symmetrical wings, and a U-shaped stirrup whose base, which is common to the legs thereof, is supported by the border, the respective ends of the wings and of the legs being joined together and said bar having a triangular-shaped section whose apex is turned to face said common base.

DESCRIPTION OF THE DRAWINGS

The invention will be better understood from the following description, with reference to the accompanying drawings in which:

FIG. 1 shows a first embodiment, in accordance with the prior art, of a strip of border-held contacts, the holding region being formed by pyramids;

FIG. 2 shows two elevational views, in two perpendicular directions, of the contact point obtained by this first method;

FIG. 3 shows a second embodiment, according to the prior art, of a contact strip where the holding region comprises a pair of inclined planes;

FIG. 4 shows two elevational views, in two perpendicular directions, of the contact point obtained by this second method;

FIG. 5 shows one embodiment of a strip of border-held contacts in accordance with the invention;

FIG. 6 shows two elevational views, in two perpendicular directions, of the contact point obtained by using the contact strip of the invention.

DESCRIPTION OF THE PREFERRED EMBODIMENT

FIG. 1 shows a first embodiment, in accordance with the prior art, of a strip of border-held contacts.

It comprises a support 1 or "border", and a plurality of rectangular-section contact elements 2, one of the sides of the rectangle 3 being parallel to the plane of the border.

The holding region 4 is reduced in section and is connected with the contact and its support by means of two pyramids 5 and 6; the one which is situated on the contact side forms, after separation as shown at (b), the insertion point.

Thus, the pyramid is entirely formed during manufacture of the contact and this latter is connected to the border solely by the point of the pyramid.

During fitting, the contacts are separated from the border by "breaking", obtained for example by a two-and-fro movement either of the contacts, or of the border, or by shearing.

This solution presents three major drawbacks:

point of the pyramid very truncated;

extremely fragility of the border attachment, leading to deformations and even to loss of contacts during handling and surface treatments, and preventing for this reason packing in reels;

automatic mounting not very possible.

FIG. 2 shows two elevational views, in two perpendicular directions corresponding to the sides of the rectangular section of the contact, of the contact point obtained by this first method.

This point has the shape of a truncated pyramid 20, whose truncation area 21 is large if it is desired to overcome the drawbacks described earlier in detail. According to dimensions given by way of typical orders of size, this truncation for a pyramid with an angle at the apex of 40°, is a square measuring 0.4 mm per side.

FIG. 3 shows a second embodiment, according to the prior art, of a contact strip in which, in the holding region, the border comprises a pair of inclined planes.

In part (a) of the figure, there is shown a contact before separation. The holding region has two inclined planes 31 and 32, forming a dihedron whose solid angle of intersection is parallel to the plane of the border; it may be obtained by stamping during cutting out, in the direction of the thickness of the metal of the border.

During mounting, the contacts are separated from the border by cutting out a second dihedron 33 perpendicular to the existing dihedron and by intersection of the two dihedrons, a pyramid 34 is obtained. This solution presents however two drawbacks:

even greater truncation of the pyramid;

fragility of the border attachment in the transverse direction, with the same consequences as those which were mentioned above.

FIG. 4 shows two elevational views, in two perpendicular directions, of the contact point obtained by the second known method, illustrated in FIG. 3.

The still large truncation 41 may be noted therein, corresponding to the need to arrange, by means of a truncated dihedron, for a certain mechanical resistance of the holding of the contact on the border during handling and processing.

On the other hand, separation of the contact by cutting, perpendicularly to the plane of the border, with a V-shaped tool, allows the adoption, without looking for mechanical resistance, of a reduced dimension in the direction perpendicular to the plane of the border.

According to dimensions given by way of typical orders of size, this truncation is in the direction parallel to the border, 0.3 mm for an angle at the apex of the dihedron of 40° and, in the perpendicular direction, where it assumes the shape of a portion of a cylinder 42, a diameter of 0.3 mm for an angle between the two corresponding faces of the pyramid of 40°.

FIG. 5 shows an embodiment of a strip of border-held contacts in accordance with the invention, in two parts (a) (b) corresponding respectively to the strip before and after separation of the contact.

According to the invention, the contact element 2 is fixed to border 1 by means entirely independent of those which define the point to be formed. It is then easy, on the one hand, to confer on the attachment to the border, all the qualities of strength the need for which was mentioned above in detail and, on the other hand, to confer on the point of the contact a shape with truncation as reduced as the stamping and cutting-out processes allow.

For holding the contact on the border, the contact is provided with two lateral wings 51 and 52, disposed in the plane of the border, similarly to the horizontal bar of the capital letter T, and these wings are supported, at their ends, by the corresponding ends of a U-shaped stirrup 53, whose common base 54 connecting the two legs is supported by the border 1. For the sake of clarity, a broken line has been shown in the figure.

This arrangement thus transfers, advantageously, the supporting function to means disposed externally of the region of the point, with the possibility of giving thereto dimensions adapted to the strength requirement mentioned above.

The formation of the point is obtained in two steps. The first one is provided during manufacture by stamping, along a dihedron with two inclined planes 55 and 56, whose solid angle of intersection 57 is parallel to the plane of border 1. But, in comparison with the prior art, it is easy to form, without limitations, a dihedron with reduced truncation going as far, as shown in FIG. 5, as a sharp edge, with an opening such as 58.

In the direction perpendicular to the plane of the border, the V-shaped cutout 59, shown in part (b), allows on separation, as in the case of the prior art of FIG. 4, a point to be obtained having reduced truncation with a portion of a cylinder.

In sum, the point obtained is thus finer because of the dihedron with a finer angle of intersection 57, with all the advantages which accrue therefrom.

And this result is obtained with, simultaneously, great strength of the border attachment in all directions, which considerably reduces the risk of deformation during handling and surface processing and the possibility of high-speed automatic mounting, due to a better geometry of the assembly of contacts on the border, and packing in reels containing a large number of contacts.

FIG. 6 shows two elevational views, in two perpendicular directions, of the contact point obtained in accordance with the invention.

There will be noted therein, as a result of the arrangements described and illustrated in FIG. 5, the very reduced truncation in the direction parallel to the border, obtained by means of the sharp edge characteristic of the invention.

In the perpendicular direction, the pyramid made with a V-shaped cutting-out tool has a shape of a portion of a cylinder with small radius.

According to typical dimensions, the residual truncation has a dimension, in the direction parallel to the border, less than 0.15 mm, for an angle at the apex of 40° and in the other assumes the shape a portion of a cylinder with a radius less than 0.15 mm, these dimensions being considerably smaller than those of contacts of the prior art.

It will be noted finally that in its fundamental structure the invention uses two lateral wings leaving, as shown in FIG. 5 at 58, a gap with the base 54 of the V-shaped support.

However, the case in which a metal wall exists between the lower edge 57 of the dihedron and the common base 54 of the stirrup which serves as support therefor, a case well-adapted to the stamping process which comprises crushing of the metal of the border, must be considered as being included within the scope of the invention.

Measurements of efficiency during manufacture on an automatic machine, effected by the Applicant, have shown that the fineness and the dimensions of the pyramid-shaped point, obtained by implementation of the invention, are such that the success of penetration of the contact, either into its support (insulating block or printed card), or into the rotary sleeve of the wiring tool, is very close to 100%.

What is claimed is:

1. In a strip of border-held contact elements for a connection device, comprising a support forming the border, in the form of a ribbon, and a plurality of contact elements in the form of rectangular-section rails, secured by one of their ends to one of the sides of the border by a securing means, in a comb arrangement, the border, the elements and their securing means being formed from the same continuous electrically conducting material, said securing means is formed by a bar disposed perpendicularly to the axis of the rail along two symmetrical wings, and a U-shaped stirrup whose base, which is common to the legs thereof, is supported by the border, the respective ends of the wings and of the legs being connected together and said bar having a triangular-shaped section whose apex is turned to face said common base.

2. The strip of contact elements as claimed in claim 1, wherein said apex presents a truncated part.

3. The strip of contact elements as claimed in claim 2, wherein a closed wall extends between said truncated part and the common base of the legs of the stirrup.

* * * * *